United States Patent [19]

Giancaspro et al.

[11] Patent Number: 5,044,512

[45] Date of Patent: Sep. 3, 1991

[54] BOTTLE APPARATUS

[76] Inventors: Joseph C. Giancaspro, 925 S. Maple, Maricopa County, Ariz. 85206; Robert F. Sassman, 615 W. Chilton, Chandler, Maricopa County, Ariz. 85224

[21] Appl. No.: 626,251

[22] Filed: Dec. 12, 1990

[51] Int. Cl.[5] ..... B65D 55/16; B65D 23/10

[52] U.S. Cl. ..... 220/90.2; 220/94 R; 220/375; 215/306; 215/1 A

[58] Field of Search ..... 215/1 A, 227, 229, 306; 220/90.2, 90.4, 90.6, 375, 94 R

[56] References Cited

U.S. PATENT DOCUMENTS

| | | | |
|---|---|---|---|
| 2,815,879 | 12/1957 | Hermes | 215/306 X |
| 3,633,586 | 1/1972 | Sheridan | 215/306 X |
| 4,448,316 | 5/1984 | Hiroshige | 215/1 A |
| 4,478,346 | 10/1984 | Spong | 220/90.2 |
| 4,850,495 | 7/1989 | Wallace | 215/101 |

FOREIGN PATENT DOCUMENTS

| | | | |
|---|---|---|---|
| 1372428 | 10/1962 | France | 215/306 |

*Primary Examiner*—Stephen Marcus
*Assistant Examiner*—Vanessa M. Roberts

[57] ABSTRACT

A sport bottle includes a container for a liquid and a cover which seals to the container and which includes an aperture through which a straw extends. The straw extends outwardly from the cover to allow the user to drink from the container. A flexible handle element is secured to the cover and is disposed over the straw to allow the user to hold both the container and the straw. The handle element includes a cap for the straw so that the straw may be covered or closed when the sports bottle is not being used for drinking purposes. The cap prevents the liquid from sloshing out of the bottle and also prevents dirt, or the like, from entering through the straw and keeps the end of the straw or the portion of the straw which contacts the users lips, from accumulating dust, dirt, and the like.

7 Claims, 1 Drawing Sheet

BOTTLE APPARATUS

BACKGROUND OF THE INVENTION

1. Field of the Invention

This invention relates to bottles and, more particularly, to bottles having a top cover lid, a drinking straw, and an integral handle secured to the cover lid and to the drinking straw, and providing a cap for the drinking straw.

2. Description of the Prior Art

The popularity of bicycle riding and jogging, and the like, has popularized the use of portable liquid carrier vehicles or bottles which a shopper, a rider, jogger, etc., may easily utilize while riding, running, walking, etc. Such containers are typically referred to as "sports bottles" and typically hold varying amounts of liquids. Such sports bottles typically include a cylindrical container or cup with a cover or lid that fits relatively tightly or in a relatively well defined sealing relationship with the container or cup so that the water or other liquid refreshment in the container does not spill out under the typical circumstances in which the container is employed.

To facilitate the drinking, the cover or lid includes an aperture and a straw extends through the aperture. The straw is in a generally tight engagement with the aperture so as to provide a relatively good seal to prevent the liquid from sloshing out of the cap through the aperture. Moreover, the straw is relatively strong and is designed for a relatively long term use. That is, the straw is not relatively flimsy so as to be discarded after a single use. Rather, just as the container or cup is designed to be refilled and this is a relatively permanent element, the straw is also designed to be a relatively permanent element, capable of withstanding usage over a relatively long period of time.

While such sports bottles are in relatively wide spread use, and are used under varying circumstances, there is a requirement that the sports bottle be kept in a relatively upright position, or at least have the upper tip of the straw above the liquid levels a sufficient distance to prevent the liquid refreshment from flowing out through the straw.

A sports bottle may be used in a variety of situations, such as secured to a frame of a bicycle, to a belt of a jogger, or it may be carried by the hand, etc. Regardless, of the particular use, the bottle apparatus may be subjected to dust, dirt, etc., as well to splashing, sloshing, etc., which may resort in problems with the straw.

Another potential problem with the container itself is that the container must be grasped by the user for drinking purposes and for handling purposes. For persons with small hands, holding the container may require the use of both hands. Similarly, persons with small hands may not be able to safely and conveniently carry the apparatus with one hand.

The apparatus of the present invention overcomes some of the limitations or problems of the prior art by providing a sports bottle with a handle or strap secured to both the cover and the straw.

SUMMARY OF THE INVENTION

The invention described and claimed herein comprises a sports bottle which includes a container, a cover that seals to the container, a straw in sealing engagement with the cover, and a strap secured to both the cover and the straw and which includes a cap for the straw at the distal end of the strap, remote from the cover. The strap is flexible and is movable relatively to the straw. The strap is also sufficiently rigid so as to comprise a handle.

Among the objects of the present invention are the following:

To provide new and useful sports bottle apparatus;

To provide new and useful cover apparatus for a liquid container;

To provide a cover for a liquid container and a strap secured to the liquid container to define a handle;

To provide a container having a cover sealing the container, a straw extending through the cover into the container and sealed to the container, and a removable strap secured to the cover and to the straw; and To provide new and useful strap apparatus for the cover of a container and defining a handle for the container.

DESCRIPTION OF THE PREFERRED EMBODIMENT

Figure 1:
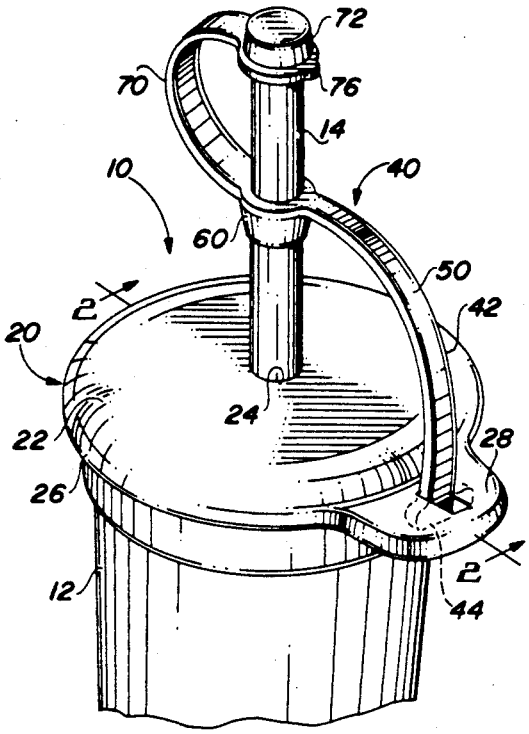
FIG. 1 is a perspective view of the apparatus in the present invention in its use environment.

FIG. 1 is a perspective of bottle apparatus 10 which includes a container or cup portion 12, a cover or lid portion 20, handle and cap portion 40, and a straw 14. The lid 20 is appropriately secured to the cup 12, and the straw 14 extends through an aperture 24 in the lid 20, and the cap and handle apparatus 40 is secured to both the lid 20 and the straw 14.

Figure 2:
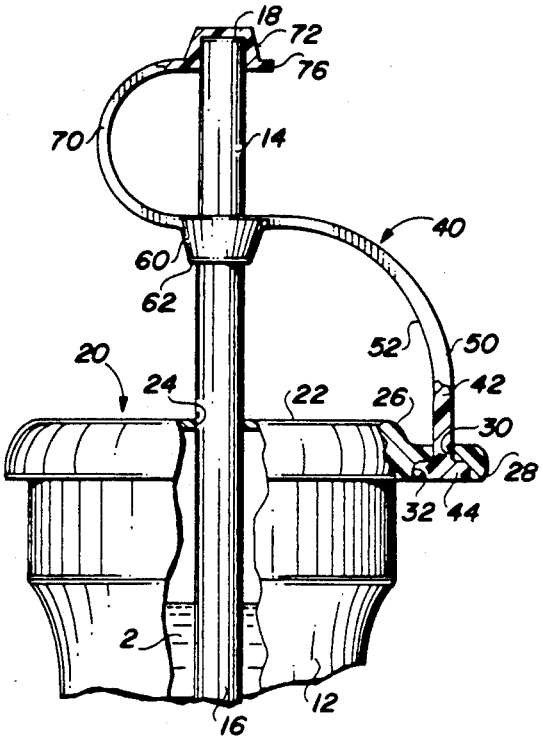
FIG. 2 is a view in partial section taken generally along 2—2 of FIG. 1.

FIG. 2 is a view in partial section taken generally along line 2—2 of FIG. 1, and comprising a side view of the sport bottle apparatus 10. For the following general discussion of the cup 12, the straw 14, and the lid 20, reference will primarily be made to FIGS. 1 and 2.

Within the cup 12 is a liquid 2. The straw 14 includes a lower portion 16 which extends into the liquid 2. Remote from the lower portion 16 of the straw 14 is a outer end 18.

The lid 20 includes a top portion 22 and straw receiving aperture 24 in the top portion 22. The straw 14 is shown extending through the aperture 24. The outer end 18 of the straw 14 is above the lid 20.

As is well known and understood, with sport bottles, the aperture 24 through the top 22 generally has about the same inner diameter as the outer diameter of the straw 14 so as to provide some degree of frictional engagement between the two to help retain the straw 14 in place in the lid 20. That is, the straw 14 will not move easily in the aperture 24 in the top 22. Rather, the straw 14 is secured by a frictional engagement with the lid.

While the frictional engagement need not be great, there nevertheless is sufficient frictional engagement between the straw 14 and the top 22 of the lid 20 to insure that the straw 14 remains in place without a positive force being applied to the straw 14 to move the straw relative to the lid 20.

Outwardly from the top 22 of the lid 20 is a rim 26. The rim 26 extends outwardly and downwardly over the outer edge of the cup 12. A positive engagement between the rim 26 of the lid 20 and the cup 12 is made to insure the lid 20 remains in place on the cup 12. Again, this is typical or common with sports bottle type apparatus.

Extending outwardly from the rim 26 is a tab 28. The tab 28 includes a top hole or slot 30 and a bottom recess 32 extending outwardly from the hole or slot 30. The hole or slot 30 and the recess 32 cooperate with the handle and cap apparatus 40 to secure the handle and cap apparatus to the lid 20.

Figure 3:
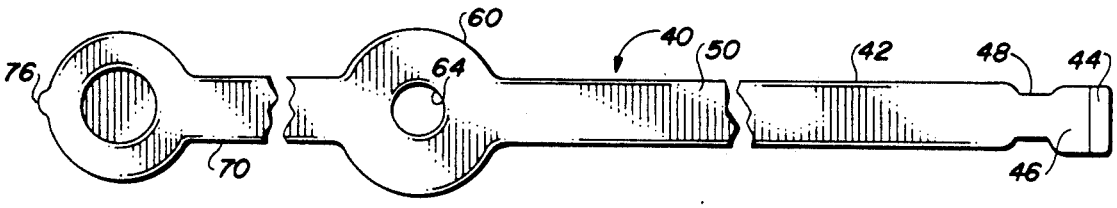
FIG. 3 is a top view of a portion of the apparatus of the present invention.
Figure 4:
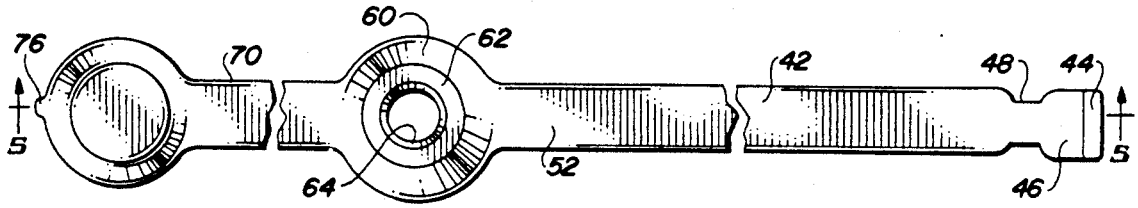
FIG. 4 is a bottom plan view of the apparatus of FIG. 3.
Figure 5:
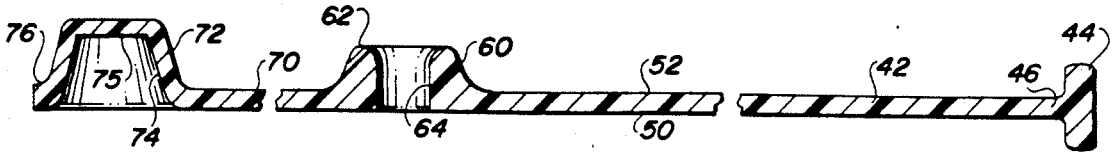
FIG. 5 is a view in partial section taken generally along line 5—5 of FIG. 4.

FIG. 3 is a top plan view of the handle and cap apparatus 40, illustrating its general configuration. FIG. 4 is a bottom plan view of the handle and cap apparatus 40, and FIG. 5 is a view in partial section through the handle and cap apparatus 40, taken generally along line 5—5 of FIG. 4. For the following discussion of the handle and cap apparatus 40, and its relationship to the lid 20 and the straw 14 reference will be made to all five of the figures.

The handle and cap apparatus 40 includes several different portions, as best shown in FIGS. 3, 4, and 5. The portions include a handle and strap portion 42, a retainer tab 44, a bottom portion 46 on the retainer tab 44, and a neck portion 48. The neck portion 48 is disposed between the strap portion 42 and the bottom portion 46. The retainer tab 44 extends outwardly substantially perpendicularly to the handle and strap portion 42. This is best shown in FIG. 5.

For securing the handle cap apparatus 40 to the lid 20, the retainer tab 44 is moved against the strap portion 42 and pushed through the slot 30. When the retainer tab 44 is through the slot 30, the tab 44 will move, due to the resiliency of the material out of which the handle and cap apparatus 40 is made, to its normal outwardly extending position as shown in FIG. 5. The strap portion 42 is then pulled upwardly to seat the retainer tab 44 in the recess 32. The strap 42 is also turned 90 degrees, as best shown in FIG. 1, in order to seat the tab 44 in the recess 32. In such orientation, the neck 48 is disposed in the slot 30. This is best shown in FIGS. 1 and 2.

The handle and strap apparatus 40 may be removed from the cap 20 in substantially the reverse steps as discussed above.

As indicated above, the handle and cap apparatus 40 is made out of resilient material that will bend and return to its original configuration, without cracking, etc. Moreover, the handle and cap apparatus 40 will bend and retain its shape, and yet provide the necessary stiffness to allow the strap portion 42 to effectively become a handle for the sports bottle apparatus 10. Hence the sometimes reference to "handle and strap portion 42."

As best visualized in FIGS. 1 and 2, there is top surface 50 and a bottom surface 52 of the strap 42. With the retainer tab 44 in the recess 32, and the neck 48 disposed in the slot 30, the surface 50 of the strap 42 becomes the top surface of the handle and strap portion 42, and the surface 52 becomes the bottom surface. It will also be noted that there is a pair of side surfaces that extend between the top and bottom surfaces, but they need not be discussed in detail. The purpose for specifically identifying the top and bottom surfaces is primarily to illustrate the orientation of the handle and strap portion 42 relative to the lid 20 and to the tab 28, the slot 30 and the recess 32.

A straw retainer 60 is disposed in the strap 42 remote from the tab 44. The straw retainer 60 is a generally truncated conical portion which extends generally downwardly from the bottom surface 52 of the strap 42. However, as shown best in FIGS. 2 and 3, the straw retainer 60 is substantially wider than the strap 42. The straw retainer 60 includes a bottom surface 62 remote from the strap 42, and a bore or straw retaining aperture 64 extends through the retainer 60.

The inner diameter of the bore 64 is about the same as the outer diameter of the straw 14. As with the aperture 24 in the top 22 of the lid 20, there is substantial frictional engagement between the straw 14 and the bore 64. Thus, when the straw retainer 60 is in place on the straw 14, as desired by the user of the apparatus 40 and the sports bottle 10 with its lid 20, the strap 42 will remain in place with respect to the straw 14, and the straw 14 will remain in place with respect to the lid 20. The strap 42 then comprises a handle for the sports bottle apparatus 10 for handling the entire sports bottle 10, as required by a user, while using only a single hand. The strap portion 42 also may be used as a hanger for hanging the sports bottle apparatus 10 on a convenient hanger support, etc.

Extending outwardly from the straw retainer 60, and generally aligned with the strap 42, is a retainer strap portion 70. The retainer strap 70 terminates in a cap portion 72. The cap 72 includes an interior portion 74 which receives the outer end of the straw 14.

Extending outwardly form the cap 72, remote from the retainer strap 70, and generally aligned with the retainer strap 70, is a tab 76. The tab 76 is used to easily and conveniently remove the cap 72 from the end 18 of the straw 14 to enable a user to have access to the end of the straw 14 for drinking the liquid 2 from within the cup 12. With the cap 72 in place on the straw 14, the tab 76 is generally aligned with the handle strap 42. Accordingly, a user of the sports bottle apparatus 10 may grasp the handle strap 42 with one hand, and with the thumb of the same hand may contact the tab 76 to flip the cap 72 off the end 18 of the straw 14. The straw 14 is then available for use to enable the user of the sports bottle apparatus 10 to drink from the cup 12.

As is best shown in FIG. 5, the cap 72 has a generally truncated conical exterior configuration. The inner portion 74 of the cap 72 has a similar configuration. The wall of the inner portion 74 extends generally inwardly to an end wall 75. When in place over the end of the straw 14, the wall 75 is in contact with the top 18 of the straw 14, and the inner portion 74, which comprises the side wall of the cap 72, is disposed about the straw 14 downwardly from its outer end.

While the wall or inner portion 74 has an inwardly extending and decreasing diameter, the flexibility of the cap 72, or the flexibility of the material out of which the cap 72 is made, together with the flexibility of the straw 14, or of the material out of which the straw 14 is made, and the appropriate dimensions of the elements, allows a relatively secure fit between the cap 72 and the straw 14 so that the cap 72 remains in place on the end of the straw 14 until a positive upward movement is placed on the cap 72, or on the tab 76 of the cap 72, to remove the cap.

It is the steadily decreasing diameter of the inner portion 74 that allows the cap 72 to essentially grip the straw 14 in an interference fit to secure the cap in place on the end of the straw 14. However, the interference fit is not so strong or so solid that the cap 72 may not be released relatively easily by a user's thumb pushing upwardly and providing a pivoting movement on the tab 76 as the handle strap 42 is held in the users hand.

The handle and cap apparatus 40 is appropriately dimensioned with respect to the length of the handle strap portion 42 and the retainer strap 70 to enable the straw retainer portion 60 to be placed or located on the straw 14 as desired by a user. The dimensions also provide the handle strap portion 42 in a configuration, curved as illustrated in FIGS. 1 and 2, to enable a user to be comfortable in holding the sports bottle 10 in one hand, flip off the cap 72 with a thumb, and drink through the straw 14. If desired and as convenient to the user, two handed handling of the bottle apparatus 10 and particularly the cup 12 or the strap and handle 42 with respect to the cap 72 is also easily accomplished.

At the same time, the frictional engagement and interference fit between the straw 14 and the straw retainer 60 is such that will enable the straw retainer 60 to remain in place on the straw 14 regardless of the amount of fluid in the cup 12. However, the interference fit or frictional engagement between the straw 14 and the aperture 24 in the lid 20 is similarly tight enough or solid enough to allow the straw 14 to remain in place relative to the lid 20.

The handle and cap apparatus 40 may be made out of any appropriate material, and may be made of any appropriate color, etc., as desired. There are several types of plastics available that may be appropriate materials. Various color combinations may also be employed, as desired.

For sanitary purposes, the sports bottle apparatus 10 may be washed with hot water, etc., without destroying either the resiliency of the various elements or their ability to retain the interference fits and accordingly the frictional engagements, as discussed above. The frictional engagements, of course, include the frictional engagement, by what ever appropriate means, including a locking arrangement, between the lid 20 and the cup 12. It will be noted that all of the weight of the liquid in the cup will be placed on the lid 20 through the straw 14 and the handle and cap apparatus 40 when the sports bottle is in its use position and when the apparatus 10 is held and/or handled only by a single hand.

The frictional engagement between the cup 12 and the lid 20, the straw 14 and the lid 20, and the straw retainer 60 and the cap 72 with the straw 14 are, of course, also sealing relationships or engagements that prevent the liquid within the cup 12 from spilling out regardless of the orientation of the cup 12. The sealing relationships also prevent any contamination of the liquid within the cup from an exterior source. The liquid is accordingly effectively sealed in the cup 12 against contamination from the outside and against leakage from the inside. However, the sealing engagement is not so great as to prevent the equalization of pressure inside and outside of the cup 12 so that neither the cup 12 nor the straw 14 collapse as liquid is drawn therefrom through the straw 14.

What I claim is:

1. Sports bottle apparatus, comprising in combination:

a cup for holding a liquid;

lid means secured to the cup, including a top portion, and an aperture extending through the top portion;

a straw extending into the cup through the aperture in the lid means and terminating in an end remote from the cup; and handle and cap means for providing a handle for holding the cup and for covering the end of the straw, including a first portion secured to the lid means;

a straw retainer portion secured to the straw between the end of the straw and the lid, a handle portion extending between the first portion and the straw retainer portion, a cap portion covering the end of the straw; and a retainer strap portion extending between the straw retainer portion and the cap portion.

2. The apparatus of claim 1 in which the lid means further includes a tab portion, and the first portion of the handle and cap means is secured to the tab portion.

3. The apparatus of claim 2 in which the lid means further includes slot means in the tab portion through which the first portion of the handle and cap means extends.

4. The apparatus of claim 3 in which the first portion of the handle and cap means includes retainer tab means disposed in the slot means for securing the handle and cap means to the lid means.

5. The apparatus of claim 1 in which the handle and cap means further includes a bore in the straw retainer portion through which the straw extends, and the bore provides a frictional engagement with the straw to secure the straw retainer portion to the straw.

6. The apparatus of claim 1 in which the handle and cap means further includes a tab on the cap portion for releasing the cap portion from the end of the straw.

7. The apparatus of claim 1 in which the first portion of the handle and cap means is releasably secured to the lid means.

* * * * *